US010075786B2

(12) United States Patent
Larsen

(10) Patent No.: US 10,075,786 B2
(45) Date of Patent: Sep. 11, 2018

(54) HEADPHONE EARPIECE COVER

(71) Applicant: Jared Larsen, Kaysville, UT (US)

(72) Inventor: Jared Larsen, Kaysville, UT (US)

( * ) Notice: Subject to any disclaimer, the term of this patent is extended or adjusted under 35 U.S.C. 154(b) by 0 days.

(21) Appl. No.: 15/413,226

(22) Filed: Jan. 23, 2017

(65) Prior Publication Data

US 2017/0215000 A1 Jul. 27, 2017

Related U.S. Application Data

(60) Provisional application No. 62/281,420, filed on Jan. 21, 2016.

(51) Int. Cl.
*H04R 1/10* (2006.01)

(52) U.S. Cl.
CPC ..... *H04R 1/1091* (2013.01); *H04R 1/1008* (2013.01); *H04R 1/1058* (2013.01)

(58) Field of Classification Search
CPC .... H04R 1/10; H04R 2205/022; H04R 1/105; H04R 5/0335; H04R 2201/10; H04R 2460/13; H04R 1/1016
USPC ..... 381/370–384
See application file for complete search history.

(56) References Cited

U.S. PATENT DOCUMENTS 2,816,578 A * 12/1957 Frieder ..... D03D 1/0052 139/409
3,786,519 A * 1/1974 Aileo ..... A42B 3/10 2/209
4,669,129 A * 6/1987 Chance ..... H04R 1/1008 181/129
5,269,314 A 12/1993 Kendall et al.
5,704,069 A 1/1998 Andersson
5,862,215 A 1/1999 Garriette
7,570,758 B2 8/2009 Gathright
8,213,670 B2 * 7/2012 Lai ..... H04R 5/0335 2/171.8
8,625,833 B1 * 1/2014 Armwood ..... 381/370
D702,209 S 4/2014 Lee
D715,271 S 10/2014 Lee
2003/0081806 A1 5/2003 Young
2003/0147528 A1 8/2003 Pfaff
2006/0210062 A1 9/2006 DeMichele et al.
2014/0177897 A1 6/2014 Baik

FOREIGN PATENT DOCUMENTS

| | | |
|---|---|---|
| DE | 7511848 | 1/1976 |
| DE | 4217361 | 12/1993 |
| DE | 29620652 | 4/1997 |
| FR | 2572607 | 2/1986 |
| GB | 4397 | 5/1914 |
| GB | 598030 | 2/1948 |
| GB | 1330757 | 9/1973 |

(Continued)

*Primary Examiner* — Suhan Ni
(74) *Attorney, Agent, or Firm* — Kunzler, PC

(57) ABSTRACT

Described herein is a headphone earpiece cover for covering an earpiece of a headphone, the headphone earpiece including a first portion, second portion, and third portion. The headphone earpiece cover includes a first fabric configured to overlay the first portion of the earpiece, a second fabric configured to overlay the second portion of the earpiece, and a third fabric configured to overlay the third portion of the earpiece. The first fabric, second fabric, and third fabric are different from each other.

15 Claims, 5 Drawing Sheets

(56) References Cited

FOREIGN PATENT DOCUMENTS

| | | |
|---|---|---|
| GB | 2139850 | 11/1984 |
| GB | 2468128 | 9/2010 |
| JP | H1169497 | 3/1999 |
| KR | 20020097116 | 12/2002 |
| WO | 8906479 | 7/1989 |
| WO | 9322888 | 11/1993 |

* cited by examiner

HEADPHONE EARPIECE COVER

CROSS-REFERENCE TO RELATED APPLICATION

This application claims the benefit of U.S. Provisional Patent Application No. 62/281,420, entitled "HEADPHONE EARPIECE COVER" and filed on Jan. 21, 2016, which is incorporated herein by reference.

TECHNICAL FIELD

This disclosure relates generally to headphones and covers for headphones, and more specifically to a headphone earpiece cover apparatus with a plurality of fabrics and methods of covering headphone earpiece with a cover.

BACKGROUND

The durability of electronic devices in environmental conditions is of major interest in industrial and consumer electronics. In electronic applications, headphones are frequently exposed to harsh environments (e.g., sweat, water, steam, even corrosive elements, etc. and combinations thereof) which can cause failure of electronic components and circuits over time.

People sometimes exercise while listening to music through headphones. Sweat and germs brought about by the exercise can build up over time on the headphones, causing one or more surfaces of the headphones to become unsanitary, faded, etc. Cleaning headphones can be damaging to the electronic components and thus a reliable way of keeping headphones free of sweat and germs can be difficult.

SUMMARY

There remains, therefore, a need in the art to provide methods and apparatuses that offer extended protection of headphones from exposure to unwanted materials, as well resistance to buildup of the unwanted materials and also provide a simple avenue for cleaning the unwanted materials off of the apparatuses. The subject matter of the present application has been developed in response to the present state of the art, and in particular, in response to the shortcomings of associated with keeping headphones clean, that have not yet been fully solved by currently available techniques. Accordingly, the subject matter of the present application has been developed to provide a cover for protecting headphones that overcomes many or at least some shortcomings in the prior art.

According to one embodiment, headphone earpiece cover for covering an earpiece of a headphone includes a first fabric configured to overlay a first portion of the earpiece, a second fabric configured to overlay a second portion of the earpiece, and a third fabric configured to overlay a third portion of the earpiece. The first fabric, second fabric, and third fabric are different from each other. The headphone earpiece includes a first portion, second portion, and third portion.

In certain implementations of the headphone earpiece cover, the first fabric, second fabric, and third fabric are different materials from each other. In some implementations, the first fabric includes a polyester blend According to some implementations of the headphone earpiece cover, the second fabric includes at least one of neoprene, polyurethane, and polyethylene.

In some implementations, the second fabric includes a polyester mesh and a lamination disposed on a side of the polyester mesh. In some implementations, the lamination includes at least one of polyurethane and polyethylene.

In some embodiments, the third fabric includes a mesh.

In some embodiments, the first fabric overlays a housing portion of the earpiece of a headphone.

In some embodiments, the second fabric overlays a cushion portion of the earpiece.

In some embodiments, the third fabric overlays a speaker portion of the earpiece.

In some embodiments, the first fabric includes a friction-inducing element coupled to the second fabric and configured to frictionally engage an outer surface of the earpiece.

In some implementations, the friction-inducing element circumferentially engages the outer surface of the earpiece to seal against the earpiece and prevent contaminants from passing between the headphone earpiece cover and the earpiece.

According to one embodiment, a headphone system is disclosed. The headphone system includes a headphone and a headphone earpiece cover. The headphone includes one or more earpieces, each comprising a first portion, a second portion, and a third portion. The headphone earpiece cover includes a first fabric configured to overlay the first portion of the earpiece, a second fabric configured to overlay the second portion of the earpiece, and a third fabric configured to overlay the third portion of the earpiece. The first fabric, second fabric, and third fabric are different from each other In some implementations, the first fabric, second fabric, and third fabric are different materials from each other. In some implementations, the first fabric includes a polyester blend.

In some implementations, the second fabric includes at least one of neoprene, polyurethane, and polyethylene.

In some implementations, the second fabric includes a polyester mesh and a lamination disposed on a side of the polyester mesh. In some implementations, the lamination includes at least one of polyurethane and polyethylene. In some implementations, the lamination is disposed on a cushion portion of the earpiece In some implementations, the third fabric includes a mesh.

In some implementations, the first fabric overlays a housing portion of the earpiece of a headphone, the second fabric overlays a cushion portion of the earpiece, and the third fabric overlays a speaker portion of the earpiece.

In some implementations, the first fabric includes a friction inducing element coupled to the second fabric and configured to frictionally engage an outer surface of the earpiece In some implementations, the friction-inducing element circumferentially engages the outer surface of the earpiece to seal against the earpiece and prevent contaminants from passing between the cover and the earpiece.

According to one embodiment, a method of covering an earpiece of a headphone with a headphone earpiece cover is disclosed. The method includes providing a headphone earpiece, including a first portion, a second portion, and a third portion and providing a headphone earpiece cover including a first fabric, a second fabric, and a third fabric. The method further includes overlaying the first fabric over the first portion of the headphone, overlaying the second fabric over the second portion of the headphone, and overlaying the third fabric over the third portion of the headphone.

In some implementations, overlaying the first fabric over the first portion of the headphone includes engaging a friction-inducing element of the headphone earpiece cover with the first portion to seal against the earpiece and prevent contaminants from passing between the headphone earpiece cover and the headphone earpiece The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the present subject matter will be readily understood, a description of the present subject matter will be rendered by reference to specific embodiments that are illustrated in the appended drawings. Understanding that these drawings depict only typical embodiments of the present subject matter and are not therefore to be considered to be limiting of its scope, the present subject matter will be described and explained with detail through the use of the accompanying drawings, in which.

DETAILED DESCRIPTION

The subject matter of the present disclosure has been developed in response to the present state of the art associated with headphones. Accordingly, the subject matter of the present disclosure has been developed to provide an apparatus for keeping headphones free of sweat and germs that overcomes many or at least some shortcomings in the prior art.

Reference throughout this specification to features, advantages, or similar language does not imply that all of the features and advantages that may be realized with the subject matter of the present disclosure should be or are in any single embodiment of the subject matter. Rather, language referring to the features and advantages is understood to mean that a specific feature, advantage, or characteristic described in connection with an embodiment is included in at least one embodiment of the subject matter of the present disclosure. Thus, discussion of the features and advantages, and similar language, throughout this specification may, but do not necessarily, refer to the same embodiment.

Illustrated in FIGS. 1-5 are several representative embodiments of a headphone earpiece cover and method of using the same. As described herein, the headphone earpiece cover and method provide several significant advantages and benefits over other headphone earpiece covers and methods. However, the recited advantages are not meant to be limiting in any way, as one skilled in the art will appreciate that other advantages may also be realized upon practicing the present disclosure.

Figure 1:
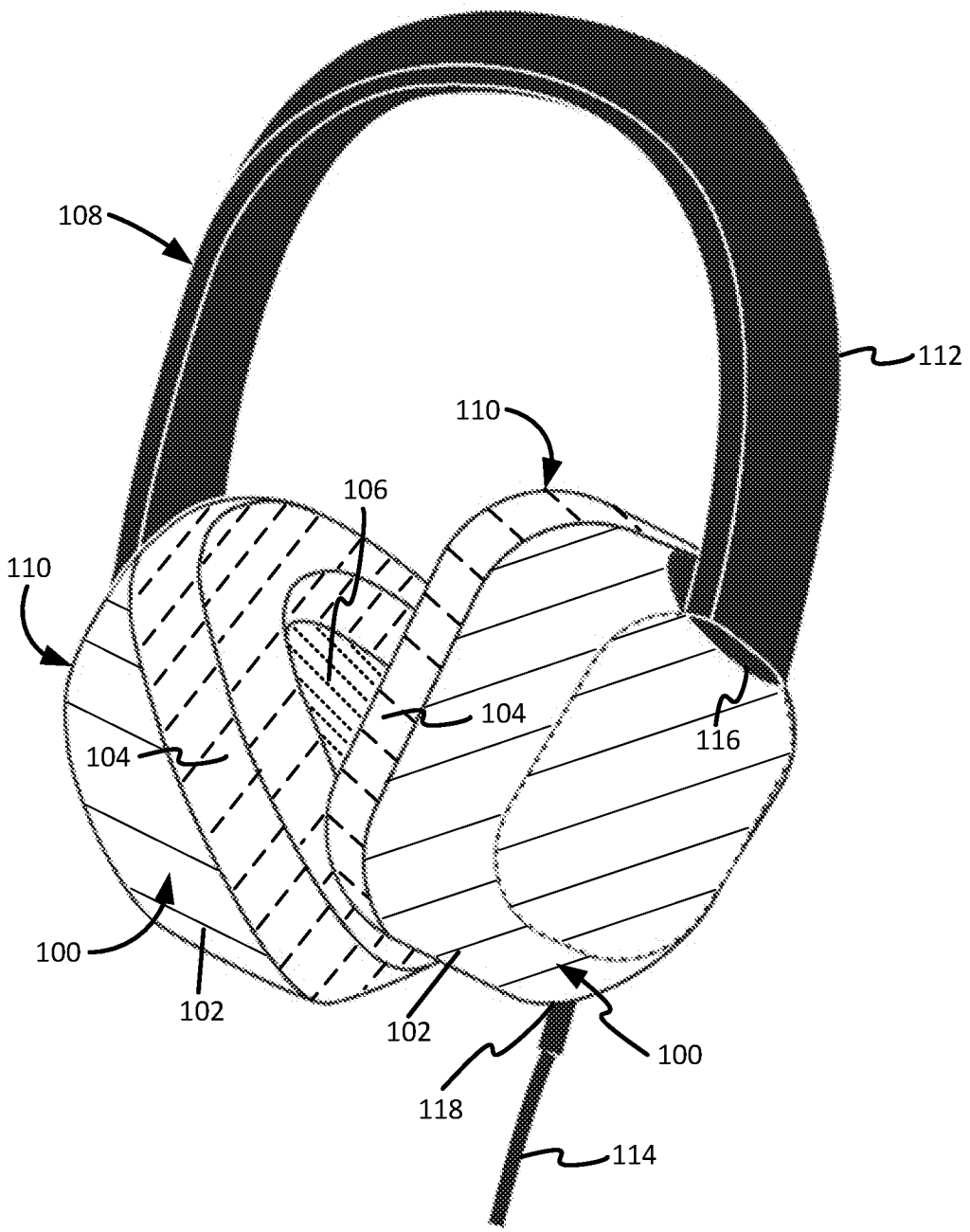
FIG. 1 is a perspective view of a headphone earpiece cover apparatus covering earpieces of a headphone, according to one or more embodiments of the present disclosure.

FIG. 1 is a perspective view of one embodiment of a headphone earpiece cover apparatus 100 covering earpieces 110 of a headphone 108. Generally, the headphone 108 may be any of various headphones known in the art that is placeable in a listening position over, on, or inside a user's ear for communicating sound to the ear. The headphone 108 may have two earpieces 110 that communicate sound to a respective one of the user's ears. A band 112, coupling the earpieces 110 together, is configured to rest on top of and/or on the side of a user's head to support the earpiece 110 in the listening position.

Figure 2:
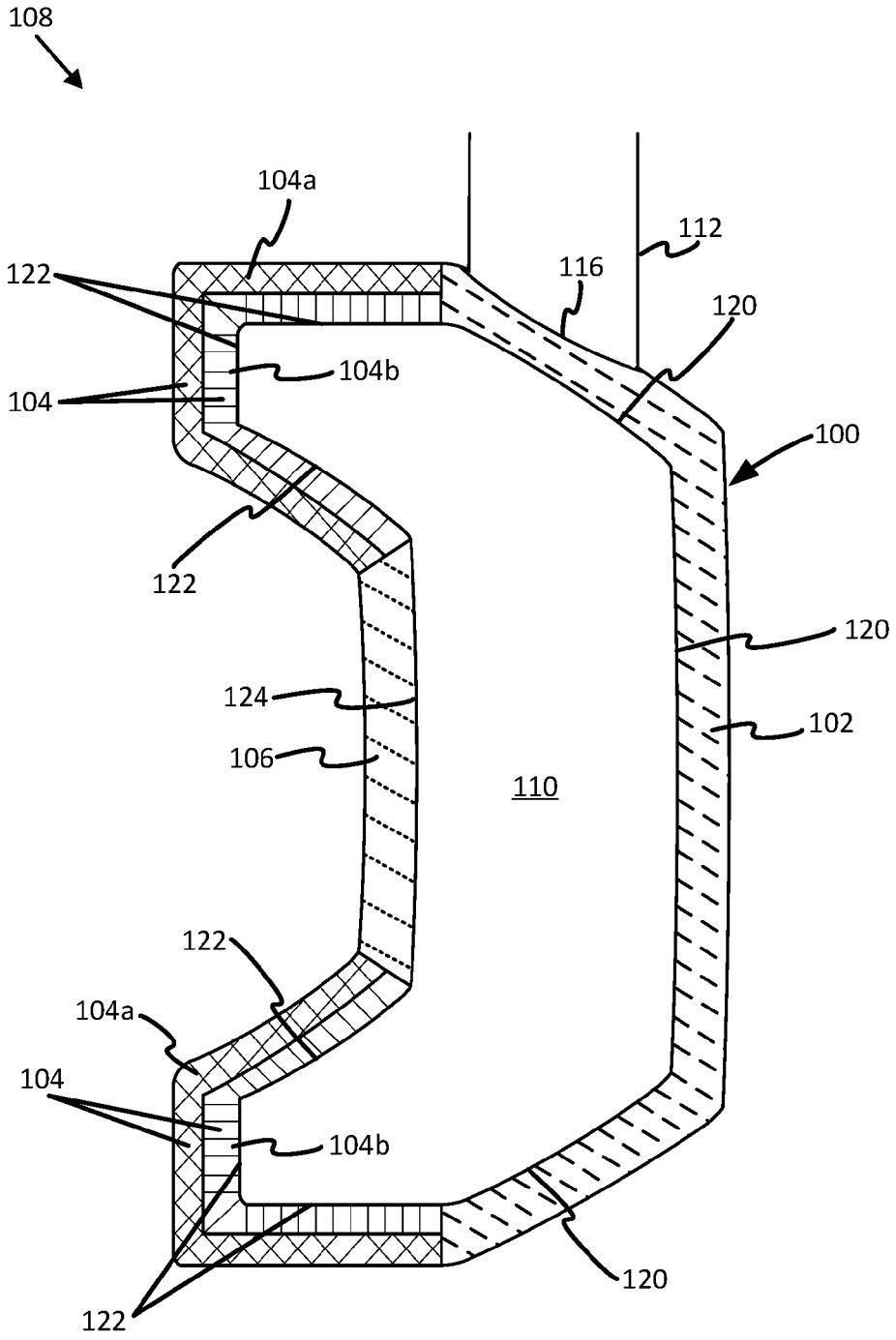
FIG. 2 is a cutaway side view of a headphone earpiece cover apparatus, according to one or more embodiments of the present disclosure.

In certain implementations, in the listening position, each earpiece 110 is disposed on an outside portion of a user's ear and surrounds the user's ear. Alternatively, each earpiece 110 may only partially surround a user's ear. For example, each earpiece 110 of the headphone 108 may include earbud portions (not shown) that fit inside a user's ear. In this example, the term "inside a user's ear," as used herein, may include the concha of the outer ear. The term may also include the end of the ear canal immediately adjacent to the outside of the ear. Referring to FIG. 2, each earpiece 110 includes a housing portion 120, a cushion portion 122, and a speaker portion 124. The housing portion 120 surrounds and protects a portion of the components of the earpiece 110. The cushion portion 122 is disposed around the speaker portion 124, as depicted in FIGS. 1 and 2, and may include a cushioning material. In some implementations, the cushion portion 122 includes a portion of an earpiece 110 that surrounds the ear of a user. Generally, the cushion portion 122 is configured to engage a user's head, and may be made of a flexible or cushioning material to facilitate the comfort of such engagement. The speaker portion 124 may communicate sound to a user's ear.

In one embodiment, although not shown, the headphone 108 includes a headset. The headset includes a microphone that protrudes from an earpiece 110. In one embodiment, the microphone includes an aperture on the microphone that receives sound. Additionally, the headphone 108 may include one or more wires, cables, or the like, such as wire 114. The wire 114 may transmit one or more of power and sound to the earpieces 110. In certain embodiments, the headphone 108 may be a cordless or wireless headphone such that power and/or sound is communicated to the earpieces 110 wirelessly. As mentioned above, the band 112 couples together the earpieces 110 of the headphone 108. In certain embodiments, although not shown, the headphone 108 may include one or more buttons, knobs, scroll wheels, or the like. A user may interact with the one or more buttons etc. to control one or more functions of the earpiece 110 and/or headphone 108.

Each cover 100 may be a single layer, multi-section headphone earpiece cover. The cover 100 is considered a single layer, multi-section cover because it includes at least one layer of at least two fabrics, such as a first fabric 102, a second fabric 104, and a third fabric 106. The term "single layer," as used herein, means that the first fabric 102, second fabric 104, and third fabric 106 each overlay a different section of an earpiece 110, and do not overlay one another. However, the term "single layer," as used herein, does not mean that a fabric may not include multiple layers of that same fabric. The term "multi-section," as used herein, means that the first, second, and third fabrics 102, 104, 106 overlay different distinct portions of the headphone, as discussed below, and that the cover 100 does not include a uniform fabric or uniform layers of fabric overlaying all or nearly all portions of the earpiece 110. The "single layer" and "multi-section" properties of the cover 100 will become more apparent as discussed below.

The cover 100 may protect the earpiece 110 from sweat, germs, or other contaminants by preventing the sweat, germs, or other contaminants from contacting the earpiece 110. The cover 100 may fit tightly against the exterior of the earpiece 110. Each cover 100 may overlay two or more distinct portions of the headphone earpiece 110 or all of the distinct portions of each earpiece 110. As mentioned above, the cover 100 includes a first fabric 102, a second fabric 104, and a third fabric 106. In one embodiment, the first fabric 102, second fabric 104, and third fabric 106 may be coupled together in a variety of ways, as will be explained in more detail below. In some embodiments, the first fabric 102, second fabric 104, and/or third fabric 106 may be flexible. A flexible fabric may stretch to tightly and securely fit over headphones 108 and earpieces 110 of different sizes and shapes.

FIG. 2 is a cutaway side view of one embodiment of a headphone earpiece cover 100. In one embodiment, the first fabric 102 overlays the housing portion 120 of an earpiece 110. The housing portion 120 may be an exterior side portion of the earpiece 110. In certain implementations, the housing portion 120 is a thin-shelled structure made from a relatively rigid material. The term "exterior side portion" may include an exterior portion of the earpiece 110 disposed on the opposite side of the earpiece 110 from the speaker portion 124 of the earpiece 110, as depicted in FIG. 2. The first fabric 102 may press tightly against the housing portion 120. The first fabric 102 covers and protects the housing portion 120. For example, the first fabric 102 may protect the housing portion 120 from dirt, dust, or other contaminants and/or protect the housing portion from being scratched or damaged. The first fabric 102 may overlay the entire housing portion 120 or may overlay just a portion of the housing portion 120. Generally, in some implementations, the first fabric 102 overlays and fits tightly against the housing portion 120.

In one embodiment, the first fabric 102 may be a resiliently flexible fabric configured to conform to the shape of the housing portion 120. For example, the first fabric 102 can be polyester, spandex, or a polyester-spandex blend. The polyester-spandex blend may include any ratio of polyester to spandex (e.g., 96% polyester and 4% spandex, 87% polyester and 13% spandex, or 82% polyester and 18% spandex). In certain implementations, the first fabric 102 may be a polyamide-spandex blend (e.g., 91% polyamide and 9% spandex). In one embodiment, one or more edges of the first fabric 102 may include a serge edge. Also, in some implementations, a water repellant may be added to the first fabric 102.

The second fabric 104 overlays the cushion portion 122 of an earpiece 110. Generally, the second fabric 104 covers and protects the cushion portion 122. Accordingly, when in place over the cushion portion 122, the second fabric 104 contacts the user's ear or head when worn by the user. The second fabric 104 can be any of various fabrics configured to wick moisture away from user's ear. For example, the second fabric 104 may include a single layer of neoprene. In another example, the second fabric 104 may include polyurethane and/or polyethylene, such as a foam (e.g., a 3 mm thick foam). Further, the second fabric 104 may include a polyester-spandex blend. Also, in some implementations, a water-repellant may be added to the second fabric 104.

According to some embodiments, the second fabric 104 may include two overlapping layers 104*a*, 104*b*, as depicted in FIG. 2. One of the overlapping layers (e.g., layer 104*a*) of the second fabric 104 may include a polyester mesh and another of the overlapping layers (e.g., layer 104*b*) of the second fabric 104 may include a lamination backing. The polyester mesh of the layer 104*a* may overlay the lamination backing of the layer 104*b* such that the lamination backing is between the cushion portion 122 and the polyester mesh. As mentioned above, the polyester mesh or the neoprene may wick moisture from the head of a user, and contain the moisture. Moreover, the polyester mesh or the neoprene may frictionally engage a user's head to prevent an earpiece of a headphone from slipping on the user's head. The lamination backing of the layer 104*b* prevents moisture, germs, or other contaminants, which have been wicked away from the user's head by the layer 104*a*, from contacting the cushion portion 122 of the earpiece 110. In some implementations, the lamination backing of the layer 104*a* may also prevent the second fabric 104 from slipping on the cushion portion 122 of the earpiece 110 by at least partially gripping or frictionally engaging the surface of the cushion portion 122 of the earpiece 110. Generally, in some implementations, the second fabric 104 overlays and fits tightly against the cushion portion 122.

Generally, the third fabric 106 overlays the speaker portion 124 of the earpiece 110 to protect the speaker portion 124 from moisture, germs, or other contaminants. The third fabric 106 may press tightly against the speaker portion 124 or may loosely overlay the speaker portion 124 of the earpiece 110. As mentioned above, the third fabric 106 covers and protects the speaker portion 124. Like the second fabric 104, the third fabric 106 can be configured to wick moisture away from the user's ear and prevent moisture from contacting the speaker portion 124. Additionally, the third fabric 106 allows sound waves from the speaker portion 124 to pass through the third fabric 106 to the user's ear with limited disruption, obstruction, or modification of the sound waves. In one embodiment, the third fabric 106 may include a mesh, such as a spacer mesh. The spacer mesh may be free of enlarged holes, apertures, or the like.

Although the first, second, and third fabrics 102, 104, 106 have been described herein as fabrics, it is recognized that any one or more of the first, second, and third fabrics can be made from a non-fibrous or non-fabric material, having the same or similar above-described characteristics of the fibers, without departing from the essence of the invention.

The first, second, and third fabrics 102, 104, 106 are coupled together, adjacent each other, in a side-by-side manner to form at least one discontinuous layer. In one embodiment, an adhesive couples together two or more of the fabrics 102, 104, 106. An adhesive may include, without limitation, glue, tape, paste, bonding, or any other adhesive or combination of adhesives. In another embodiment, two or more of the fabrics are sewn together. In some implementations, the first fabric 102 is coupled to the second fabric 104 in a different way than the second fabric 104 is coupled to the third fabric 106.

As shown, the cover 100 may include at least one aperture 116 configured to stretch and flex to enable a respective earpiece 110 to pass through the aperture and allow the cover 100 to be positioned around the earpiece 110. The aperture 116 can be formed in the cover 100, for example, in the first fabric 102, second fabric 104, and/or third fabric 106. Moreover, the aperture 116 may be formed in an upper portion, a side portion, or a lower portion of the cover 100. As mentioned, the aperture 116 may resiliently flex and stretch to temporarily increase in diameter to facilitate passage of the earpiece 110. In one embodiment, the aperture 116 may include a serge edge that may help prevent the cover 100 from fraying. Moreover, the aperture 116 can be any size or shape that allows passage of the earpiece 100 therethrough when stretched, but retains the earpiece 100 within the cover 100 when not stretched. Further, the location of the aperture 116 corresponds with the location of the band 112 of the headphone 108. In some embodiments, the aperture 116 may be formed by a friction-inducing element (a friction-inducing element is described more fully below in conjunction with FIG. 4).

In one embodiment, the cover 100 is customized to fit an earpiece 110 of a particular size and shape. For example, the size, shape, or location, of the aperture 116 may be customized to fit a particular headphone 108 and/or earpiece 110. In some examples, the size, shape, or location, of the first fabric 102, second fabric 104, and third fabric 106 relative to each other may be customized to fit and cover an earpiece 110 of a particular size and shape. In certain embodiments, the cover 100 includes an aperture 118 through which the wire 114 passes through when the cover 100 is on the earpiece 110. Additionally, in some embodiments, the cover 100 may include an aperture (not shown) through which a microphone of the headphone 108 passes through when the cover 100 is on the earpiece 110.

Figure 4:
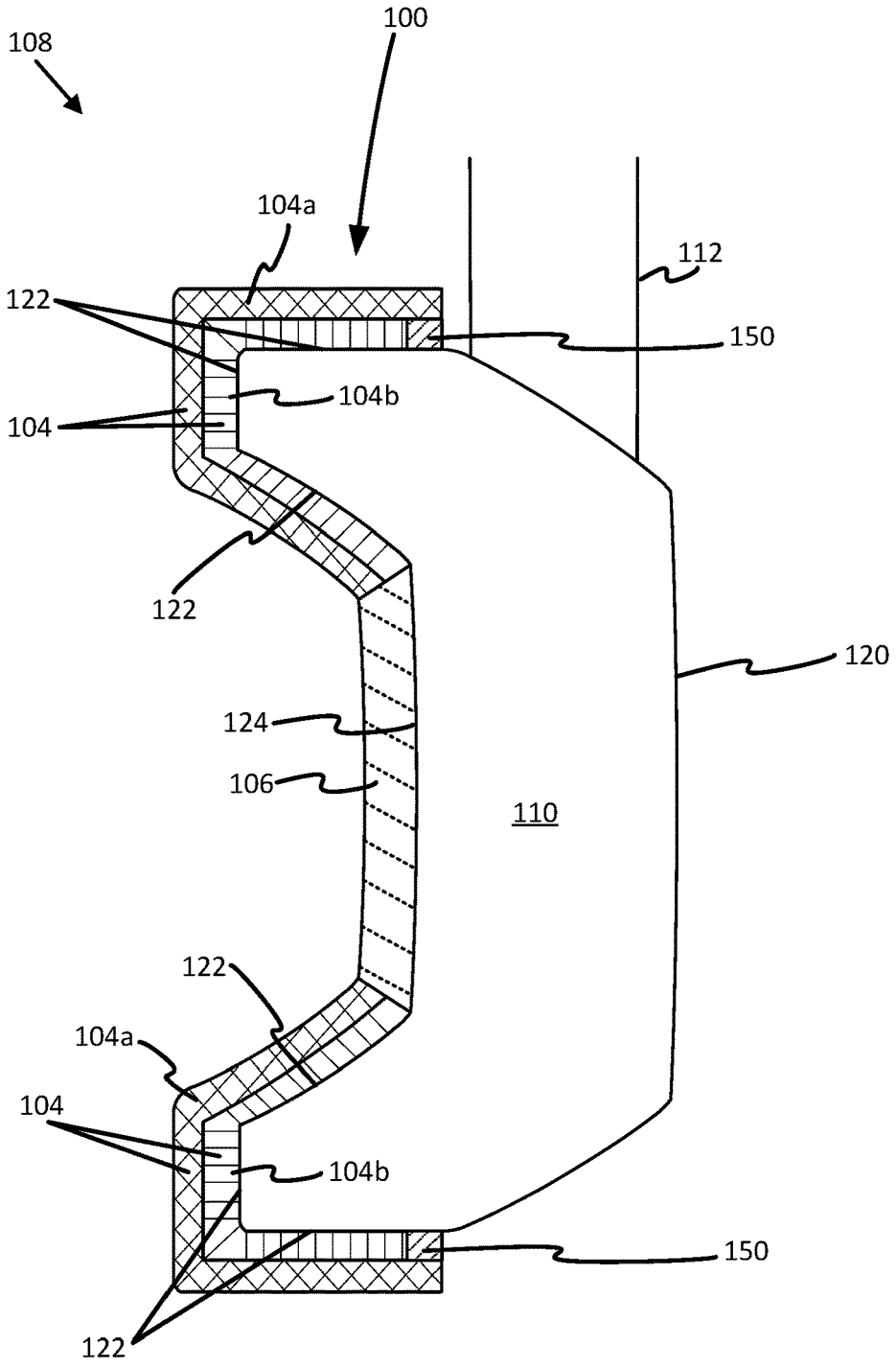
FIG. 4 is a cutaway side view of a headphone earpiece cover apparatus covering an earpiece of a headphone, according to one or more embodiments of the present disclosure.

In some embodiments, such as shown in FIG. 4, the first fabric is a friction-inducing element 150 coupled to the second fabric 104, such as at least one of the overlapping layers 104*a*, 104*b* of the second fabric 104. Generally, the friction-inducing element 150 frictionally engages an outer surface of the earpiece 110, such as the housing portion 120 of the earpiece, to promote the retention of the cover 100 on the earpiece 110. Moreover, the friction-inducing element 150 may provide a seal against the earpiece 110 to prevent contaminants from passing between the cover 100 and the earpiece 110. In some implementations, the friction-inducing element 150 includes a strip or band made from a friction-inducing material, such as rubber, silicone, or the like. The friction-inducing element 150 can be adhered, bonded, or woven to the second fabric 104. In some embodiments, the friction-inducing element 150 circumferentially engages the outer surface of the earpiece 110 to seal against the earpiece 110 and prevent contaminants from passing between the cover 100 and the earpiece 110. Although not depicted, some embodiments may include the first fabric 102 and a friction-inducing element 150 which circumferentially engages the band 112 of the headphone 108.

In some embodiments, the friction-inducing element 150 is adhered to both overlapping layers 104*a*, 104*b*. That is, the friction-inducing element 150 may be adhered along a first edge to a polyester mesh of the layer 104*a* and may be further adhered along a second edge to a lamination backing of the layer 104*b*. A third edge of the friction-inducing element 150 frictionally engages the outer surface of the earpiece 110. A fourth edge of the friction-inducing element 150 is visibly exposed when the cover 100 in placed on the earpiece 110 to allow visual inspection of the friction-inducing element 150 and determine whether the third edge of the friction-inducing element 150 circumferentially engages the outer surface of the earpiece 110 at all points around the earpiece 110. This allows a user to determine if the cover 100 has formed a seal around the earpiece 110. As the cover 100 is configured to be placed and removed for cleaning and be re-placed on the earpiece 110, determining that a seal continues to form is important as the periodic stretching may degrade the friction-inducing element 150. In some embodiments, the friction-inducing element 150 forms the aperture 116 through which the earpiece 110 inserts into the cover 100.

Figure 5:
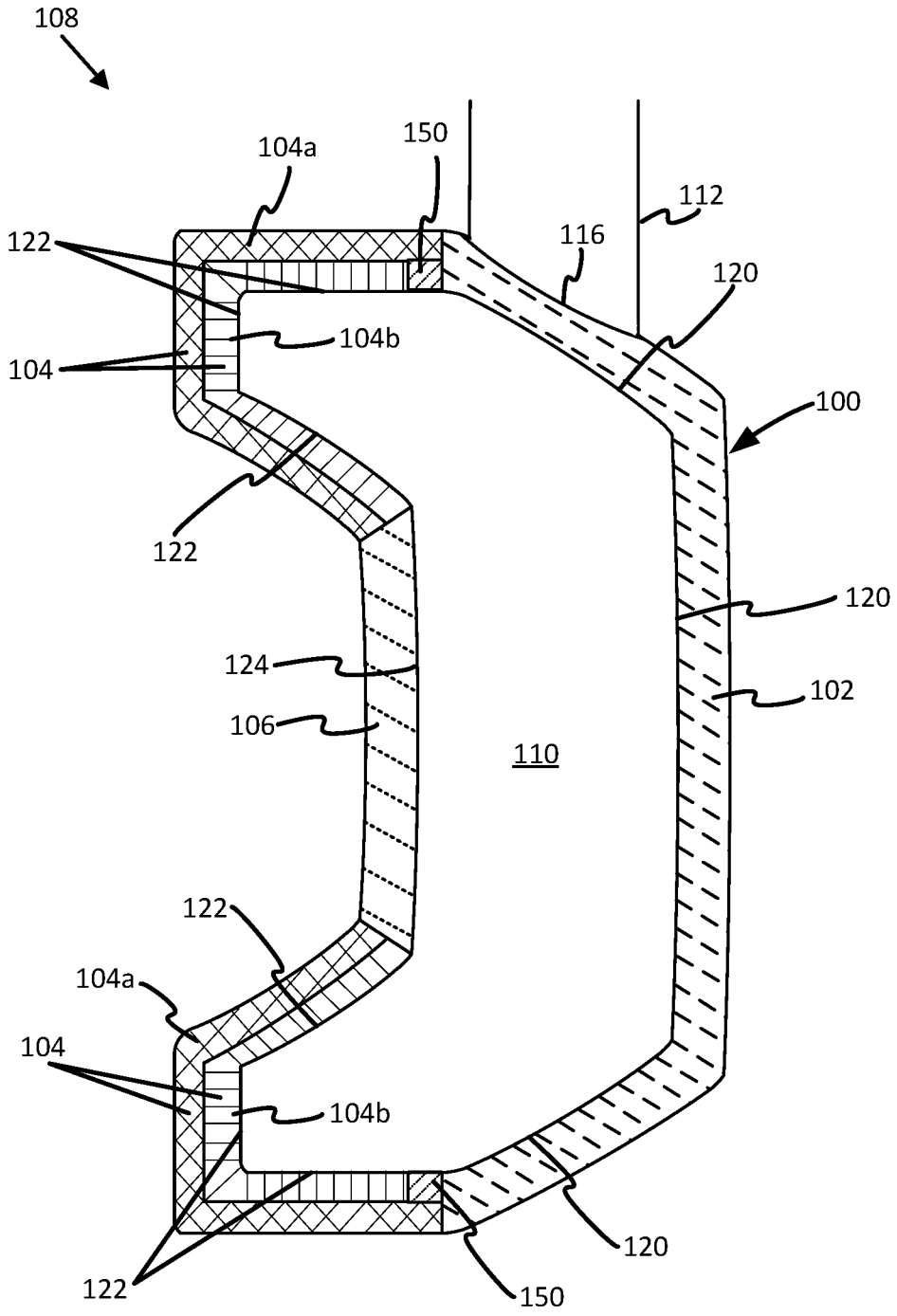
FIG. 5 is a cutaway side view of a headphone earpiece cover apparatus covering an earpiece of a headphone, according to one or more embodiments of the present disclosure.

FIG. 5 is a cutaway side view of another embodiment of a headphone earpiece cover apparatus covering an earpiece of a headphone. In some embodiments, the friction-inducing element 150 is coupled between the second fabric 104 and the first fabric 102. The friction-inducing element 150 is adhered, along a first edge, to a polyester mesh of the layer 104*a* and is further adhered, along a second edge, to a lamination backing of the layer 104*b*. A third edge of the friction-inducing element 150 frictionally engages the outer surface of the earpiece 110. The friction-inducing element 150 is adhered, along a fourth edge, to the first fabric 102. The friction-inducing element 150 may form a seal circumferentially around the outer surface of the earpiece 110 to seal off the speaker portion 124 of the earpiece 110 from the aperture 116 of the cover.

Figure 3:
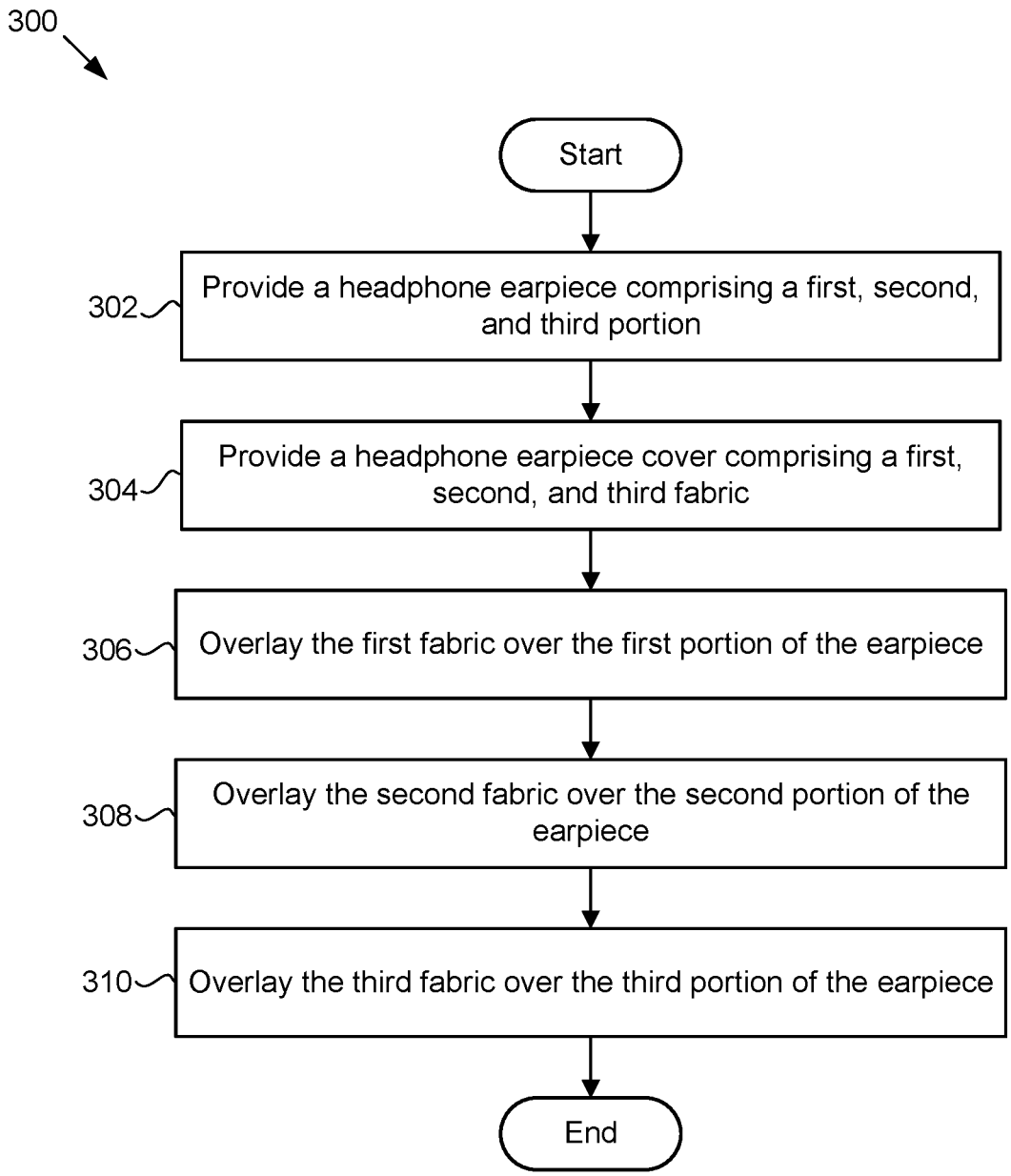
FIG. 3 is a schematic flowchart diagram of a method of covering an earpiece of a headphone with a headphone earpiece cover, according to one or more embodiments of the present disclosure.

FIG. 3 depicts a schematic flowchart diagram of a method 300 of covering an earpiece of a headphone with a headphone earpiece cover, according to one embodiment. The method 300 includes providing a headphone earpiece of a headphone at 302. The earpiece may include a first portion, second portion, and a third portion. The first, second, and third portions are made from materials different from each other. In some implementations, the first portion is the housing portion 120, the second portion is the cushion portion 122, and the third portion is the speaker portion 124. However, in other implementations, the first, second, and third portions can be other portions of a headphone earpiece. The method 300 further includes providing a headphone earpiece cover at 304. As described above, the headphone earpiece cover 100 may include a first fabric 102, a second fabric 104, and a third fabric 106. Additionally, the method 300 includes overlaying the first fabric over the first portion of the earpiece at 306. The method 300 also includes overlaying the second fabric over the second portion of the earpiece at 308. Further, the method 300 includes overlaying the third fabric over the third portion of the earpiece at 310. As described above, in one example, the first fabric overlays a housing portion, the second fabric overlays a cushion portion, and the third fabric overlays a speaker portion of the earpiece.

Overlaying the first, second, and third fabrics over the first, second, and third portions, respectively, of the earpiece may initially include inserting the earpiece of the headphone through an aperture of the headphone earpiece cover. For example, as described above, a user may stretch an aperture of the headphone earpiece cover, insert the earpiece through the aperture, and overlay the headphone earpiece cover over respective surfaces of the earpiece.

In one embodiment, the user may remove the headphone earpiece cover from an earpiece, dispose of it, and replace it with a new cover if desired. To remove the headphone earpiece cover, the user may expand one or more flexible apertures of the headphone earpiece cover and slide the headphone earpiece through the aperture. In some embodiments, the user may slide the wire out of an aperture of the headphone earpiece cover to remove the wire from the headphone earpiece cover.

It should also be noted that, in some alternative implementations, the functions noted in a block of a flowchart diagram may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

Similarly, reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A headphone earpiece cover for covering an earpiece of a headphone, the headphone earpiece comprising a first portion, second portion, and third portion, the cover comprising:

a first fabric configured to overlay the first portion of the earpiece;

a second fabric configured to overlay the second portion of the earpiece; and a third fabric configured to overlay the third portion of the earpiece;

wherein the first fabric, second fabric, and third fabric are different from each other; and wherein the first fabric comprises a friction-inducing element coupled to the second fabric and configured to frictionally engage an outer surface of the earpiece.

2. The cover of claim 1, wherein the first fabric, second fabric, and third fabric are different materials from each other, and wherein the first fabric comprises a polyester blend.

3. The cover of claim 2, wherein the second fabric comprises at least one of neoprene, polyurethane, and polyethylene.

4. The cover of claim 3, wherein the second fabric comprises:

a polyester mesh; and a lamination disposed on a side of the polyester mesh, wherein the lamination comprises at least one of polyurethane and polyethylene.

5. The cover of claim 3, wherein the third fabric comprises a mesh.

6. The cover of claim 1, wherein the first fabric overlays a housing portion of the earpiece of a headphone.

7. The cover of claim 6, wherein the second fabric overlays a cushion portion of the earpiece.

8. The cover of claim 7, wherein the third fabric overlays a speaker portion of the earpiece.

9. The cover of claim 1, wherein the friction-inducing element circumferentially engages the outer surface of the earpiece to seal against the earpiece and prevent contaminants from passing between the headphone earpiece cover and the earpiece.

10. A headphone earpiece cover for covering an earpiece of a headphone, the headphone earpiece comprising a first portion, second portion, and third portion, the cover, comprising:

a first fabric configured to overlay the first portion of the earpiece;

a second fabric configured to overlay the second portion of the earpiece; and a third fabric configured to overlay the third portion of the earpiece;

wherein, the first fabric, second fabric, and third fabric are different from each other;

wherein the first fabric, second fabric, and third fabric are different materials from each other, and wherein the first fabric comprises a polyester blend;

wherein the second fabric comprises at least one of neoprene, polyurethane, and polyethylene; and wherein the second fabric comprises:

a polyester mesh; and a lamination disposed on a side of the polyester mesh, wherein the lamination comprises at least one of polyurethane and polyethylene, and wherein the lamination is disposed on a cushion portion of the earpiece.

11. The headphone system of claim 10, wherein the third fabric comprises a mesh.

12. The headphone system of claim 10, wherein the first fabric overlays a housing portion of the earpiece of a headphone, wherein the second fabric overlays a cushion portion of the earpiece, and wherein the third fabric overlays a speaker portion of the earpiece.

13. The headphone system of claim 10, wherein the first fabric comprises a friction inducing element coupled to the second fabric and configured to frictionally engage an outer surface of the earpiece.

14. The headphone system of claim 10, wherein a friction inducing element circumferentially engages the outer surface of the earpiece to seal against the earpiece and prevent contaminants from passing between the cover and the earpiece.

15. A method of covering an earpiece of a headphone with a headphone earpiece cover, the method comprising:

providing a headphone earpiece, comprising a first portion, a second portion, and a third portion;

providing a headphone earpiece cover comprising a first fabric, a second fabric, and a third fabric;

overlaying the first fabric over the first portion of the headphone;

overlaying the second fabric over the second portion of the headphone; and overlaying the third fabric over the third portion of the headphone;

wherein overlaying the first fabric over the first portion of the headphone comprises engaging a friction-inducing element of the headphone earpiece cover with the first portion to seal against the earpiece and prevent contaminants from passing between the headphone earpiece cover and the headphone earpiece.

* * * * *